US010231581B2

(12) United States Patent
Moskowitz et al.

(10) Patent No.: US 10,231,581 B2
(45) Date of Patent: Mar. 19, 2019

(54) TOUCH POINT AREA DISPOSABLE CONTAMINATION BARRIER DISPENSING DEVICE

(71) Applicant: University of South Carolina, Columbia, SC (US)

(72) Inventors: Jay Moskowitz, Mechanicsburg, PA (US); Michael Randall, Simpsonville, SC (US)

(73) Assignee: University of South Carolina, Columbia, SC (US)

( * ) Notice: Subject to any disclaimer, the term of this patent is extended or adjusted under 35 U.S.C. 154(b) by 42 days.

(21) Appl. No.: 14/420,523

(22) PCT Filed: Aug. 16, 2013

(86) PCT No.: PCT/US2013/055254
§ 371 (c)(1),
(2) Date: Feb. 9, 2015

(87) PCT Pub. No.: WO2014/028794
PCT Pub. Date: Feb. 20, 2014

(65) Prior Publication Data

US 2015/0230672 A1 Aug. 20, 2015

Related U.S. Application Data

(60) Provisional application No. 61/742,678, filed on Aug. 16, 2012.

(51) Int. Cl.
*A47K 10/42* (2006.01)
*A47H 5/00* (2006.01)

(52) U.S. Cl.
CPC ..... *A47K 10/42* (2013.01); *A47H 5/00* (2013.01)

(58) Field of Classification Search
CPC ..... A47K 10/42
USPC ..... 221/63, 48, 303; 206/216, 449
See application file for complete search history.

(56) References Cited

U.S. PATENT DOCUMENTS 404,622 A * 6/1889 Hicks ..... A47K 10/421 221/48
1,503,161 A * 7/1924 Hornecker ..... B65D 5/5253 206/45.21
1,657,942 A * 1/1928 Spaldo ..... B65D 83/0847 206/216
2,020,876 A * 11/1935 Clark ..... B65D 5/5253 206/746
2,077,664 A * 4/1937 Beardsley ..... B42D 5/00 206/451
2,085,649 A * 6/1937 Gluck ..... B65D 83/0847 206/449

(Continued)

OTHER PUBLICATIONS

International Search Report for corresponding PCT Application No. PCT/US2013/055254 dated Feb. 7, 2014, 3 pages.

*Primary Examiner* — Rakesh Kumar
(74) *Attorney, Agent, or Firm* — Dority & Manning, P.A.

(57) ABSTRACT

A dispenser device is generally provided for removable attachment to a flexible enclosure. In one embodiment, the dispenser device comprises a dispenser body which defines a cavity therein and a plurality of barrier sheets within the cavity defined by the dispenser body. The dispenser body is configured to be removably attached over a contact point or surface of the flexible enclosure (e.g., a curtain or the like).

13 Claims, 4 Drawing Sheets

(56) References Cited

U.S. PATENT DOCUMENTS 2,122,048 A * 6/1938 Shapiro ..... B65D 5/4208 206/494
2,313,383 A 3/1943 Kolodny
2,604,253 A * 7/1952 Turner ..... B65D 5/5097 206/493
2,903,734 A 9/1959 Inman
3,113,673 A * 12/1963 Stein ..... B65D 5/4275 206/813
3,160,341 A * 12/1964 Cherney ..... B65D 5/067 206/813
3,209,941 A * 10/1965 Krake ..... A47K 10/421 206/216
3,215,332 A * 11/1965 Bess ..... B65D 5/5253 206/456
3,397,771 A * 8/1968 Fogle ..... B65D 5/0085 206/750
3,456,843 A * 7/1969 Planner ..... A47K 10/423 221/63
3,456,844 A * 7/1969 Planner ..... B65D 83/0847 221/63
3,482,734 A * 12/1969 Mierson ..... B65D 83/0811 206/494
3,554,370 A * 1/1971 Davis ..... B65D 5/38 206/449
3,612,264 A * 10/1971 Trunick ..... B65D 83/08 206/449
3,624,791 A * 11/1971 Taub ..... A47K 10/421 221/59
3,837,595 A * 9/1974 Boone ..... A47K 10/32 242/594.5
3,896,966 A * 7/1975 Canno ..... B65D 83/0852 206/494
4,070,489 A * 1/1978 Pahnke ..... B65D 5/5253 206/45.2
4,231,491 A * 11/1980 Pierson ..... A47K 10/421 221/48
4,377,237 A * 3/1983 Pawlowski ..... B65D 5/5495 229/120.011
4,513,923 A * 4/1985 Ulics ..... A47K 10/38 242/598.5
4,559,671 A 12/1985 Andrews et al.
4,605,124 A 8/1986 Sandel et al.
4,722,296 A 2/1988 Bowskill et al.
4,793,487 A * 12/1988 Bentsen ..... B65D 33/001 206/451
4,865,140 A 9/1989 Cottam
5,269,423 A * 12/1993 Nguyen ..... B65D 83/0852 206/494
5,297,749 A * 3/1994 White ..... A47K 10/3836 242/597.4
5,301,832 A * 4/1994 Daniels ..... A47F 13/085 206/554
5,332,097 A * 7/1994 Wile ..... A47F 13/085 206/493
5,368,165 A * 11/1994 Ngyuen ..... B65D 83/0852 206/494
5,405,021 A * 4/1995 Smithson ..... B65D 83/0811 206/554
5,509,527 A * 4/1996 Wang ..... A45C 11/34 206/214
5,524,763 A * 6/1996 Wile ..... B65B 43/14 206/494
5,702,081 A * 12/1997 Gallemore, II ..... A47B 96/061 248/218.4
5,737,778 A 4/1998 Black
5,769,213 A * 6/1998 Chatterton ..... A45C 1/06 15/435
5,983,454 A 11/1999 Hartselle, III
6,147,607 A 11/2000 Lynn
6,202,889 B1 * 3/2001 Veith ..... A47K 10/421 221/58
6,237,805 B1 5/2001 Katsanevas
6,289,557 B1 9/2001 Manson et al.
6,349,525 B1 * 2/2002 Veith ..... A47K 10/421 53/117
6,363,851 B1 * 4/2002 Gerhard ..... B41F 17/02 101/483
6,401,971 B1 * 6/2002 Edwards ..... B65D 5/5007 221/26
6,439,386 B1 * 8/2002 Sauer ..... B65D 5/4208 206/494
6,499,155 B1 12/2002 Barrios
6,546,594 B1 4/2003 Wills
6,548,135 B1 * 4/2003 Hershey ..... B01J 20/28023 2/49.1
6,645,435 B2 11/2003 Dawson et al.
6,789,695 B1 9/2004 Gaudreau
6,912,728 B2 7/2005 Panella
7,028,860 B2 * 4/2006 Behnke ..... A47K 10/422 221/49
7,360,674 B2 4/2008 Sassoon
7,458,742 B2 12/2008 Stropkay et al.
7,735,842 B2 6/2010 Brady et al.
7,757,351 B2 7/2010 Davis, Jr.
7,762,492 B2 7/2010 Muderlak et al.
7,784,675 B2 * 8/2010 Sutherland ..... B65D 5/5253 206/427
7,850,114 B2 12/2010 Lavy
7,854,040 B1 12/2010 Ramos
8,006,864 B2 8/2011 Fryan et al.
8,152,027 B1 4/2012 Baker
8,307,581 B2 11/2012 Badgley et al.
8,375,521 B1 2/2013 Caron
8,878,038 B1 * 11/2014 Shumaker ..... G10K 1/26 84/406
9,254,956 B2 * 2/2016 Markovic ..... B65D 5/5445
2003/0062376 A1 * 4/2003 Sears ..... A47K 10/421 221/48
2004/0020815 A1 2/2004 Panella
2005/0278840 A1 12/2005 Baloga et al.
2007/0215632 A1 * 9/2007 Bendor ..... A47K 10/42 221/63
2008/0000924 A1 1/2008 Brady et al.
2009/0200329 A1 8/2009 Balkin et al.
2010/0281781 A1 11/2010 Badgley et al.
2010/0327000 A1 12/2010 Winslow et al.
2011/0073612 A1 * 3/2011 Youssef ..... A47K 10/32 221/283
2012/0080451 A1 4/2012 Williams et al.
2014/0284291 A1 * 9/2014 Sandgrund ..... A47G 25/06 211/85.3
2015/0230672 A1 * 8/2015 Moskowitz ..... A47K 10/42 221/303

* cited by examiner

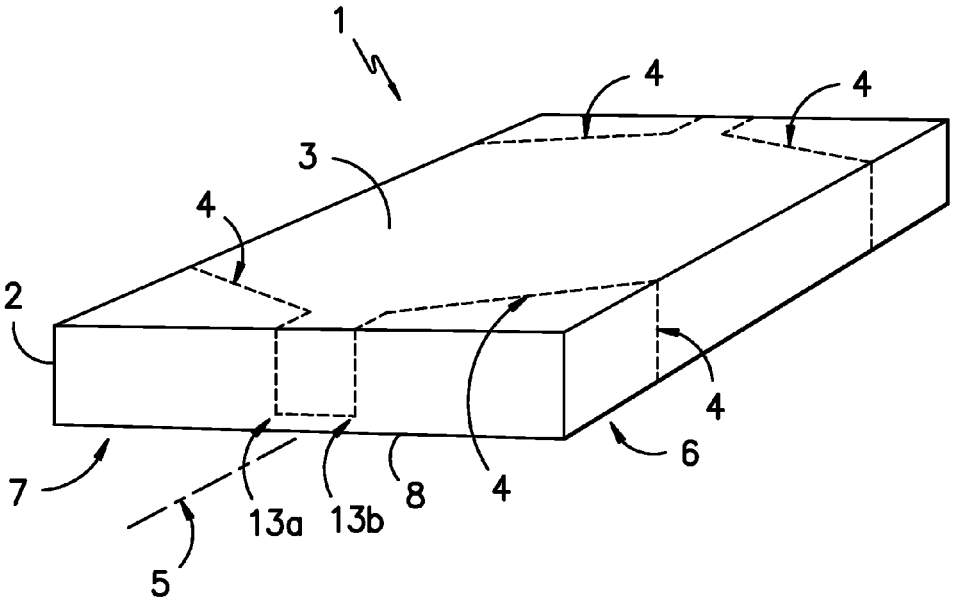
FIG. –1–
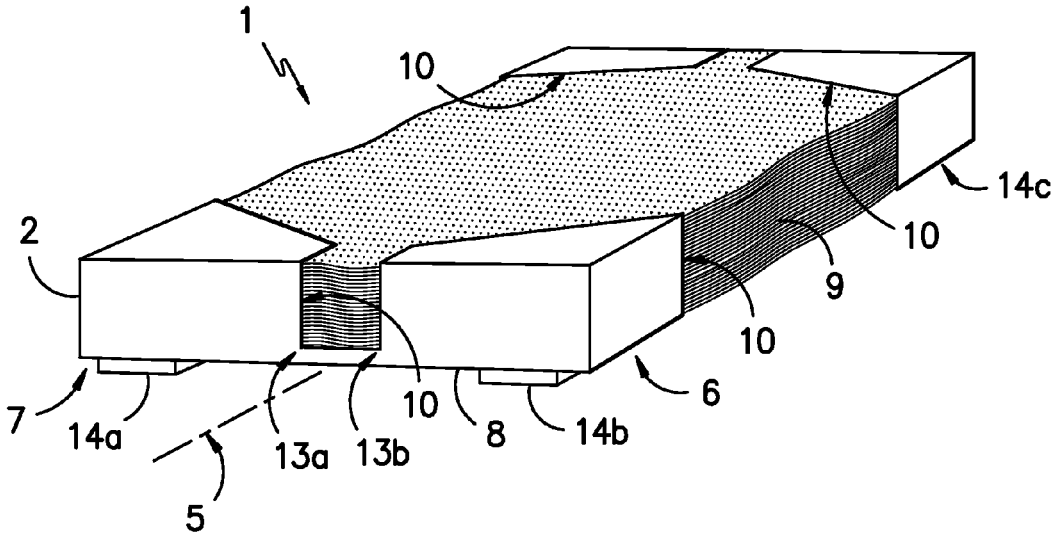
FIG. –2–

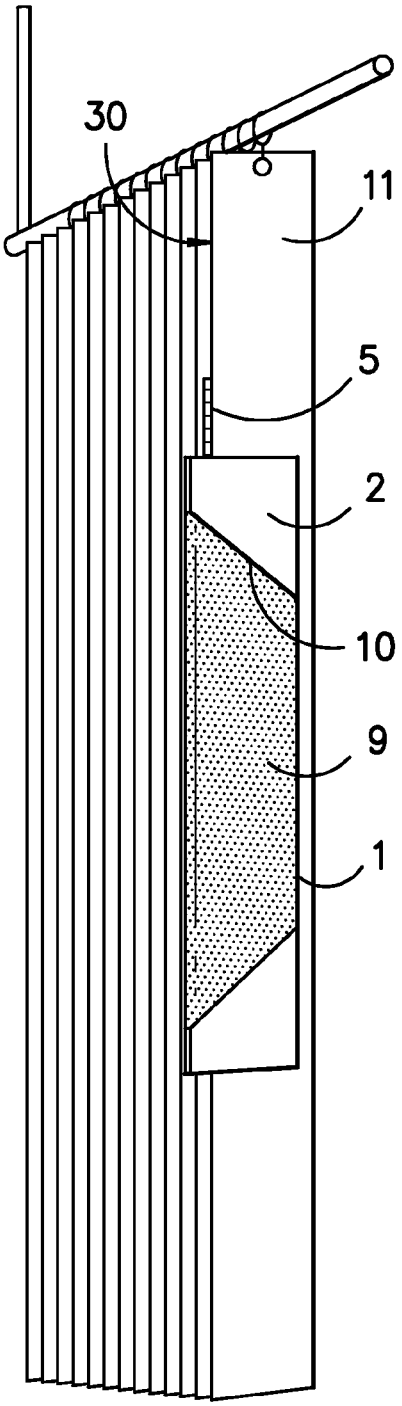
FIG. –4–
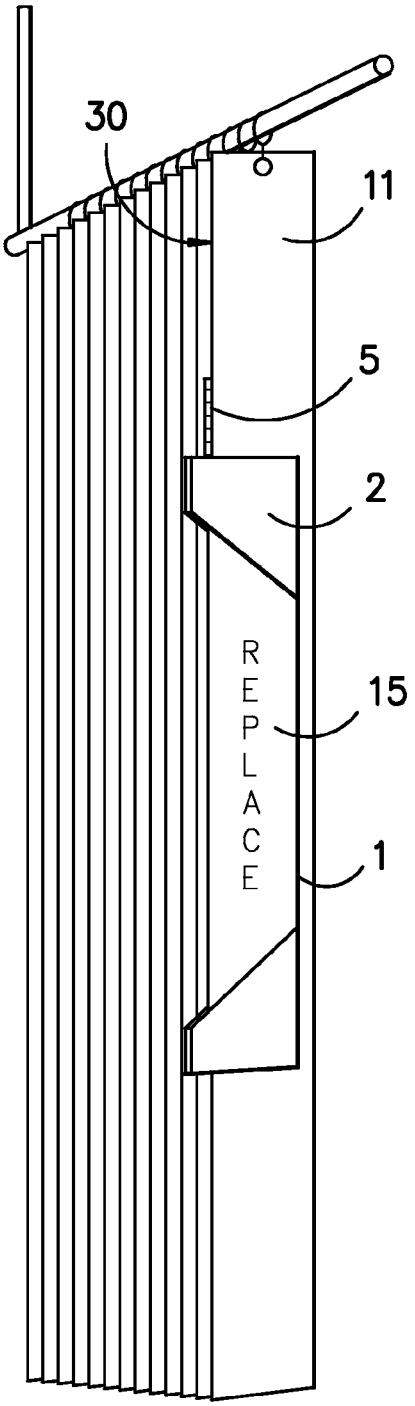
FIG. –5–

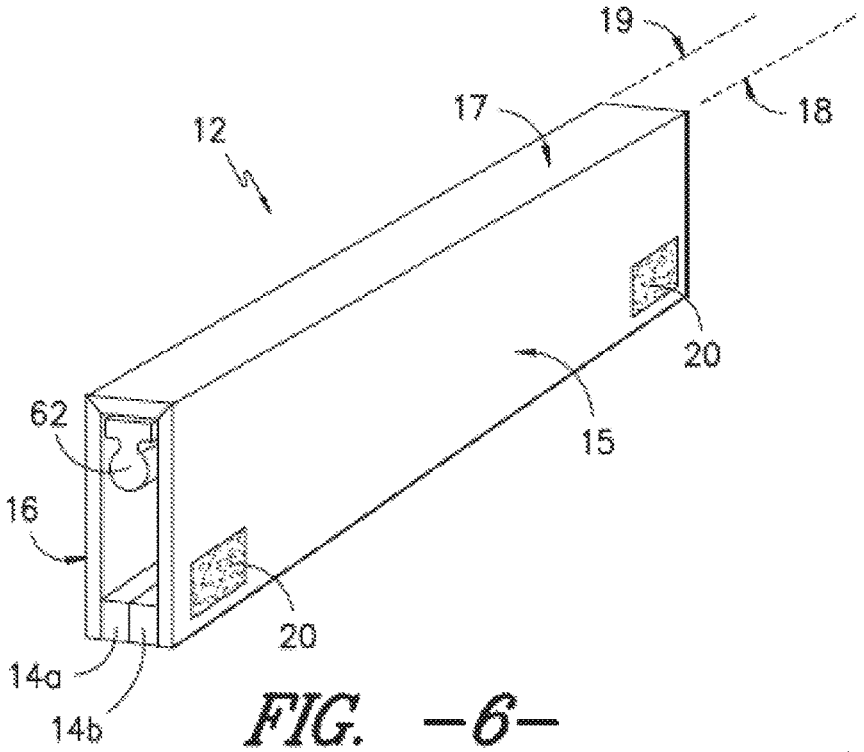
FIG. –6–
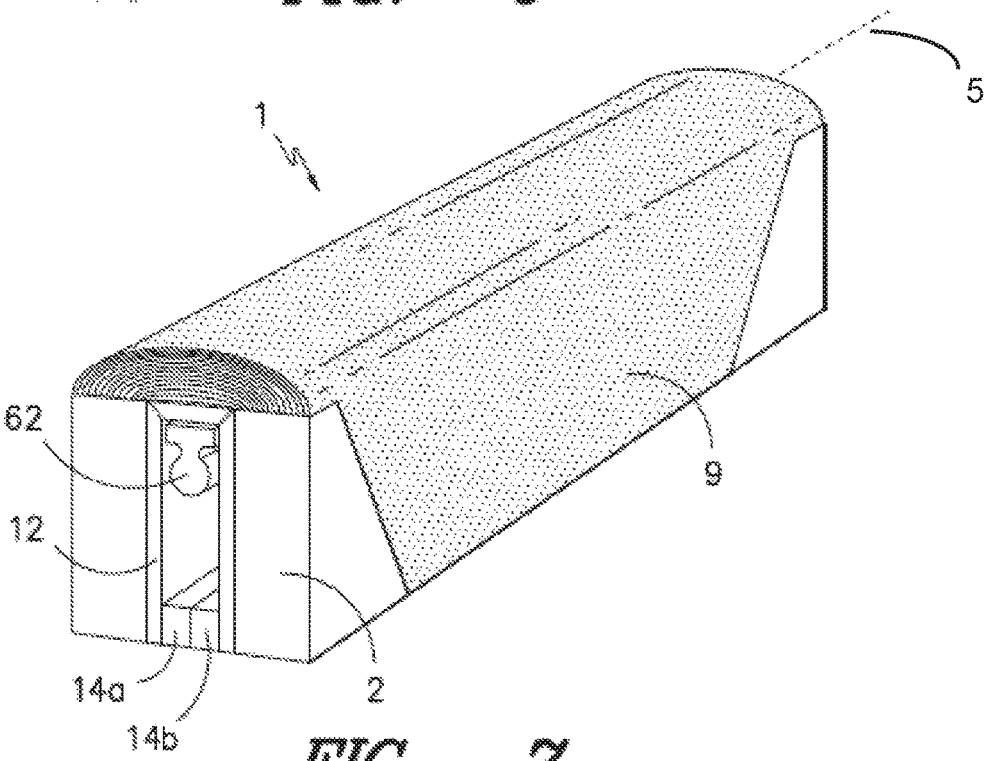
FIG. –7–

TOUCH POINT AREA DISPOSABLE CONTAMINATION BARRIER DISPENSING DEVICE

PRIORITY INFORMATION

The present application claims priority to U.S. Provisional Patent Application Ser. No. 61/742,678 titled "Touch Point Area Disposable Contamination Barrier Dispensing Device" of Moskowitz and Randall filed on Aug. 16, 2012, which is incorporated herein by reference.

FIELD OF THE INVENTION

The present invention relates to a family of improved handle-type dispensing devices to be used for opening and closing flexible enclosure devices, such as privacy curtains or the like, in a manner that substantially reduces or eliminates transmission of contamination.

BACKGROUND OF THE INVENTION

In flexible enclosures, such as privacy curtains or the like, entry into and exit from said enclosure is normally achieved with the opening and closing the enclosure. The opening and closing of such enclosures typically involves pushing or pulling of handle or pull or the like. These are defined as "touch surfaces" or "contact surfaces" and enable the user to open or close the flexible enclosure.

Such touch surfaces are often easily contaminated and may represent vectors for contamination that can lead to the spread of disease through contact transference of contamination. For example, influenza viruses may be transferred to such touch surfaces, and then transmitted to the next person in contact with the touch surface. It is estimated by the US Center for Disease Control (CDC) that influenza viruses affect 5% to 20% of the U.S population each year. The CDC also estimates that more than 200,000 people a year are hospitalized due to flu complications, and approximately 36,000 die from influenza related infection. Contamination, such as influenza virus can transfer from a contaminated touch surface and enter one's body when hands that have previously touched an infected surface also touch the mouth, nose or other area of entry for the contaminant to enter one's body. Other contaminants, that are easily transferred via contact transference include, but are not limited to, bacteria such as Methicillin-Resistant *Staphylococcus Aureus* (MRSA), or *Clostridium Difficile* (C. dif. or CDF), and the like.

Contact transference of contamination can be especially problematic in hospitals and other care facilities. These communal facilities are characterized by numerous contamination vectors, many of which involve contamination transference from one person to another via touch surfaces. This problem is common in occurrence and expensive to remediate. According to the CDC, approximately 1 out of every 20 hospital patients will experience a hospital acquired infection (HAI) and cost U.S hospitals as much as $45 B per annually. In 2002 the estimated number of HAIs in U.S. hospitals was estimated to be 1.7 M with nearly 100,000 of these HAIs resulting in death with the average cost per HAI on the order of $25,000 (2002 basis). HAI has become such a significant expense that section 5001(c) of the Deficit Reduction Act states that hospitals will no longer receive reimbursement from CMS for selected conditions related to HAI, adding significant economic burden to numerous U.S. hospitals.

Unfortunately, many of the potential contamination transference vectors characteristic of healthcare facilities are not adequately addressed currently. For example, there are no universally recognized protocols for changing privacy curtains, yet there are numerous data to indicate that they become significantly contaminated typically within one week of installation. For example, a recent presentation at an infectious diseases conference indicated that more than 90% of the curtains studied were contaminated with one or more of MRSA, *Enterococcus* spp., Vancomycin-Resistant *Enterococcus* (VRE), or aerobic gram-negative rods within one week of installation in one of either, a medical Intensive Care Unit (ICU), a surgical ICU or a medical ward. The study also noted that the samples were obtained from within an 800 square centimeter area on the leading edge of each curtain, indicating that the researchers either understood or at least hypothesized the leading edge of the hospital curtain to be an area particularly susceptible to contamination. Some curtain manufacturers recommend use of disposable curtains, changed with each change of the bedding or with each new patient. However, this can be prohibitively expensive and time consuming and health care facilities have not yet completely established this protocol for privacy curtain maintenance, despite the associated health and financial risks.

Currently to reduce or eliminate contamination of touch points, the use of disinfectants, either through mechanical cleaning, sprays or vapors is employed. In the case of privacy curtains, these methods are not practical as vapor or spays may harm or bother resident patients, and mechanical cleaning or washing involves costly and time consuming replacement and laundering of the privacy curtain. Inventions in the area of minimization or elimination of contact transference of contamination of other types of touch points have been numerous. U.S. Pat. No. 2,313,383 teaches of a flexible attach device for the rigid mouthpiece of a telephone that utilizes a roll of sanitary paper capable of being drawn across the transmitter at will and torn, and then destroyed. This ca. 1941 invention has a mechanism that allows a single sheet of paper to move across the transmitter mouthpiece and does not serve the purpose of opening or closing a flexible enclosure. Additionally, this device is not suitable for mounting to a flexible object such as a privacy curtain or the like and has moving, mechanical components to advance said single sheet of paper across the transmitter mouthpiece.

U.S. Pat. Nos. 2,903,734; 7,735,842; and US 2008/0000924 teach of a sanitary handle device serving as a rigid handle of a cart or carriage or that attaches to the rigid handle of a cart or carriage in a manner that is horizontally oriented. The devices mechanically move a single sheet of clean paper over the contact surface of said handle, in a manner similar to that taught in U.S. Pat. No. 2,313,383 using a mechanical mechanism, that is either manually or electronically actuated, that has numerous moving parts and is relatively complex and heavy and would not be suitable as a handle for a flexible item such as a privacy curtain or the like due to excessive weight, resulting in significant "pendulum effect". Mechanical actuation of these devices would require forces not suitable for an object that is not rigid or fixed, such as a privacy curtain or the like as it would create a significant "pendulum effect" with movement. The devices taught are also not designed to be attached to a flexible object in a manner that is easily removed without damaging said object.

U.S. Pat. No. 6,237,805 teaches of an improved system for a towelette/napkin dispenser consisting of a two piece unit, the box member is attached together with the back door plate member. This configuration does not serve to provide sanitary handle or pull contact surfaces and is designed for permanent attachment to a rigid structure. The invention also is likely considerably massive and would not be suitable for use as a handle or pull on a flexible device such as a privacy curtain or the like.

U.S. Pat. No. 6,546,594 teaches of a covering device for use with a door handle and interconnecting shaft extending from a hingedly secured door. The device includes an elasticized body having a substantially three dimensional shape with an inner face, an outer face, and an open inserting end defined around a narrowed neck of the body. The body further includes a flexible and plasticized material which may be covered by a soft fabric outer layer. A resilient retaining portion, such as an elasticized ring is disposed around the neck in association with the open inserting end and for securing the body in place over the door handle and shaft. Frictional engagement is provided between the inner face of the elasticized body and the door handle surface in use and is preferably provided as an adhesive tacking surface which may be incorporated into an inner ply of covering device or spray applied. A portable and carry able dispenser holds, in compressed fashion, a plurality of individual and elasticized bodies provides for the dispensing of individual ones of the bodies. The devices taught in this patent are not suitable for use on a flexible enclosure such as a privacy curtain or the like as said devices are attached to an integral handle which is lacking from said flexible enclosure device and the structures taught would not be suitable for mounting to said flexible enclosure device as it could not provide a handle function. Additionally, the dispenser taught in this patent is not mounted to the structure as a contact surface and thus cannot ensure that the contact area of said flexible device stays uncontaminated.

U.S. Pat. No. 6,789,695 teaches of door handle disinfecting/cover dispensing system wherein a handle of a door is covered by a disposable tissue when that handle is used to open the door. The tissue is dispensed from a housing mounted on the door super adjacent to the handle. Tissues from the housing are sized so the tissue will remain attached to the housing but will cover the handle. Disinfectant can be sprayed onto a handle before the handle is grasped via the tissue. Once the door is opened, a user simply pulls the tissue out of the housing and discards it. As one tissue is pulled from the housing that tissue, in turn, pulls the next tissue out of the housing. The invention taught in this patent is not suitable for mounting to a flexible enclosure device such as a privacy curtain or the like. Additionally, the attachment means is permanent and the overall device is massive and would lead to significant "pendulum effect." Additionally, the invention does not provide a handle function, but simply provides for sanitizing or covering an existing handle.

U.S. Pat. No. 8,307,581 teaches of a guard to prevent direct touch contact between an individual's hand and a handle or a contact surface of a rigid door to which a pushing or pulling force is applied to cause the door to open. According to a first preferred embodiment, a hollow cylindrical core is moved into removable surrounding engagement with a door handle. A plurality of protective strips is laid one above the other in a roll that surrounds the core. According to another preferred embodiment, a plurality of protective strips or coverings is disposed one above the other in a stack that is attached over a pushing surface of the door. Successive ones of the plurality of strips and coverings can be removed from the roll or stack and discarded following use. One surface of each of the strips and coverings is treated with a layer which includes a mixture of adhesive and microbicide. The layer of adhesive and microbicide enables the plurality of strips and coverings to be adhesively bonded to one another while discouraging the growth and spread of potentially disease-causing bacteria. This invention is not suitable for use with a flexible enclosure device such as a privacy curtain or the like, as it either mounts on a rigid handle, knob or the like, or mounts directly to a rigid surface such as a door or the like. Additionally, since each of the plurality of strips is adhesively bonded to each other, it would not be suitable for removal of an old strip to expose a new strip when attached to a flexible enclosure structure such as a privacy curtain or the like as said structure would move considerably as each of said strips is removed. Additionally, this patent does not teach of a temporary attachment means that is suitable for flexible enclosure applications such as a privacy curtain or the like.

U.S. Pat. No. 8,375,521 teaches of a sanitary door handle cover which includes a strip having five layers including a first layer formed of absorbent, breathable material, an absorbent second layer, a sanitizing third layer with pockets containing sanitizing solution which is absorbed by the first, second, and fourth layers upon the application of pressure to the strip, an absorbent fourth layer, and an adhesive fifth layer which removably adheres to a rigid door handle or door knob. A rectangular strip is applied to a midsection of a door handle, while a bilaterally symmetrical trapezoid-shaped strip is applied to a grip surface of a rigid door knob. This invention is not suitable for use with a flexible enclosure device such as a privacy curtain or the like, as it mounts on a rigid handle, knob or the like. Additionally, since the device does not contain a plurality of fresh contact surfaces, the contact surface becomes progressively more contaminated with each use and it would not be obvious when to change out the device so as to provide a clean contact surface with each use. Additionally, this patent does not teach of a temporary attachment means that is suitable for flexible enclosure applications such as a privacy curtain or the like.

Published U.S. application number US 2004/0020815 teaches of an apparatus and method for using a hygienic device to form a barrier between an object to be grasped, such as a doorknob, and a user's palm and fingers to prevent the transfer of unwanted bacteria and germs. The device is a covering for the palm and fingers of the user's hand which creates a barrier between the doorknob and the user's palm and fingers to prevent the transfer of germs thereto. The device is envisioned to have a pocket or other means to facilitate positioning of the hygienic device on the user's hand, with the pocket being of size to receive one or more fingers up to a depth of less than the middle knuckle. The method for using the hygienic device further includes providing a dispenser for holding multiple hygienic devices, a single device can be removed from the holder which is then placed upon the user's hand and is then used. After the hygienic device is used it can be disposed of as needed by the user. This invention is not suitable for mounting on a flexible enclosure device such as a privacy curtain or the like, as it mounts on one's hand and moves with a person and does not stay with said device. Additionally, during use the device does not contain a plurality of fresh contact surfaces, and the contact surface on the user's hand may become progressively more contaminated with each use and it would not be obvious when to change out the device so as to provide a clean contact surface with each use. Additionally, this patent does not teach of a temporary attachment means that is suitable for flexible enclosure applications such as a privacy curtain or the like.

Published U.S. patent application number US 2005/0278840 discloses a combination sanitary toilet seat handle and toilet tissue roll holder, which is affixed to the toilet seat ring, whereby the toilet paper roll is used as a renewable sanitary grasping surface for the handle, with which the seat may be raised or lowered without touching the seat ring or lid proper. This invention is for use with a rigid device and with a rigid connection to a toilet seat. Additionally, it works with toilet paper only, which is typically a highly permeable material and is generally well suited for contamination avoidance since liquid contamination may permeate its absorbant structure, transferring to the user's hand, and is not suitable for mounting to a flexible enclosure device such as a privacy curtain or the like.

Published U.S. patent application number US 2010/0327000 teaches of a sanitary dispensing system including an elongate member configured to be secured to a door, a dispensing device secured to the elongate member, the dispensing device configured for dispensing hand cleansing materials, and a receptacle device secured to the elongate member and configured for receiving hand cleansing materials. The invention is not suitable for mounting on a flexible enclosure device such as a privacy curtain or the like, as it mounts on a door or other rigid structure. Additionally, the device does not provide for a handle or pull to open or close the structure and would be large and bulky, resulting in a large "pendulum effect" when used with a flexible, suspended enclosure device such as a privacy curtain or the like. As used herein, the "pendulum effect" generally refers to unwanted, excessive movement of an object affixed to a flexible enclosure device due to the momentum that is created during movement, due to a relatively large suspended mass. Additionally the invention does not provide for a clean or sanitary cover over the handle or pull contact surface. Additionally, this patent does not teach of a temporary attachment means that is suitable for flexible enclosure applications such as a privacy curtain or the like.

U.S. Pat. Nos. 4,559,671 and 4,605,124 disclose a sterile handle for a surgical lamp that is meant for use with a rigid, inflexible device and that is single in nature and does not provide for a fresh contact surface with each touch at the discretion of the user. U.S. Pat. No. 4,722,296 discloses a disposable shield for a rigid handle of a light used by dentists or doctors. A new shield is used for each patient, thereby preventing the spreading of contagious diseases. This invention does not disclose the use of a shield dispenser, however, so change-outs are not easily performed. Additionally, these patents do not teach of devices that are suitable for application on a flexible enclosure device such as a privacy curtain or the like.

U.S. Pat. Nos. 5,983,454 and 6,289,557 disclose handles that change the touch point from the hand to the wrist or the back of the hand or to a foot. However, this method does not reduce contamination but move it to a different part of one's anatomy and thus, is likely only partially effective. Additionally, these patents do not teach of devices that are suitable for application on a flexible enclosure device such as a privacy curtain or the like. Use of each invention also requires that the user be trained to use the handle in a certain way that is awkward and not likely to happen without enforcement.

U.S. Pat. No. 6,499,155 discloses a dispenser for disposable handle covers that are used as a toilet flush handle protection device. This design would not work with handles or rails attached at more than one point and would not work on a curtain or other flexible enclosure device. U.S. Pat. No. 6,912,728 discloses an apparatus and method for using a hygienic device to form a barrier between an object to be grasped, such as a doorknob, and a user's palm and fingers to prevent the transfer of unwanted bacteria and germs. This invention it is not automatic in that fresh covers are not dispensed automatically at the touch point. U.S. Pat. No. 6,912,728 discloses an apparatus and method for using a hygienic device to form a barrier between an object to be grasped, such as a doorknob, and a user's palm and fingers to prevent the transfer of unwanted bacteria and germs. The device is a covering for the palm and fingers of the user's hand which creates a barrier between the doorknob and the user's palm and fingers to prevent the transfer of germs thereto. Covers are not dispensed at the touch point and have to be manually aligned and installed on one's hand as well as removed from one's hand for proper use. U.S. Pat. No. 7,854,040 discloses a portable, compact germ barrier for protecting a person from direct contact with an unsanitary surface, such as a doorknob, a toilet handle, or the like. However, this device does not dispense contamination free surfaces at the touch point and is carried by the user and does not teach of a temporary mounting method to a flexible enclosure device. Additionally, this device, when properly cleaned and maintained, may protect the user from contamination, but does not protect others from transference contamination generated from the device itself as it would become easily contaminated and is not automatically refreshed or decontaminated. None of the above patents teach of devices that are suitable for application on a flexible enclosure device such as a privacy curtain or the like or of a temporary mounting means to said enclosure device.

U.S. Pat. No. 7,458,742 discloses a door handle and liquid dispensing apparatus that includes a housing configured to attach to an associated door and a porous material. This invention involves the use of a disinfecting liquid that is likely not suitable for most applications as it frequently is desired or required to keep ones hands or gloves dry. Additionally, the invention does not provide a means for mounting to a curtain or other flexible enclosure device. U.S. Pat. Nos. 6,645,435, 7,360,674, 8,152,027, 8,006,864, 6,147,607 and U.S. Patent Published Application 2012/0080451 disclose similar devices that employ a decontamination method that requires the user to wet his or her hands or gloves. Likewise, U.S. Pat. No. 4,865,140 discloses a cover for a handle or knob that carries a disinfectant in a porous material that covers both the contacting hand(s) and the handle or knob. This method of contamination elimination/reduction involves the use of a single, layer that allows touching of the handle or knob and does not provide a dispensing mechanism for additional covers or additional disinfectant and has no means of indicating when change-out is necessary. Additionally, the above patents do not teach of devices that are suitable for application on a flexible enclosure device such as a privacy curtain or the like or of a temporary mounting means to said enclosure device.

U.S. Pat. No. 5,737,778 discloses a toilet seat actuator that remains separate from the touch surface and includes a dispenser in its handle for dispensing disposable sheaths for the graspable portion of the device. The dispenser is not described or claimed, but dispenses sheaths that are likely difficult to replace and are not applicable to touch points that are not amenable to sheathing, such as a privacy curtain, or other flexible enclosure device. The above patent does not teach of devices that are suitable for application on a flexible enclosure device such as a privacy curtain or the like or of a temporary mounting means to said enclosure device.

U.S. Pat. No. 7,762,492 discloses a device for a dispensing and collecting handle or armature cover material or covers for use, by way of example, with door handles, knobs, and the like. The device taught is a complicated electromechanical device that would be expensive and difficult to use in locations without power or without the use of batteries, or other electricity generation devices that would be complicated, expensive, bulky and require maintenance. Additionally, the above patent does not teach of devices that are suitable for application on a flexible enclosure device such as a privacy curtain or the like or of a temporary mounting means to said enclosure device.

U.S. Pat. No. 7,850,114 discloses a flat sanitary door handle mechanism incorporating a self-contained mechanical user-operated continuous material advancing system whereby the person touches a fresh length of material while using the flat door handle to open the door thus avoiding hand exposure to the surface of the flat handle which may have been contaminated by previous users. This is achieved by the pull and release of the flat door handle by the user, without any external source of power, the action of which replaces the used length of material with a fresh length and makes the handle ready for use by the next person. The device taught is complicated, mechanically complex and would be too weighty or massive to work with a suspended flexible enclosure device such as a privacy curtain or the like without prohibitive "pendulum effect" Additionally, this device requires a pulling action of the flat handle in order to advance a fresh protective sheet. This action would not be practical with a privacy curtain or other flexible enclosure device.

U.S. Pat. No. 7,757,351 discloses a wipe-dispensing device that can fit around commonly used doorknobs or door handles which are rigid devices, and a method for issuing wipes from the device so that they may be used as a protective barrier between the hand and the doorknobs. The device may include a molded circular ring made of plastic or any suitable hardened polymer. The ring fits around a doorknob or door handle so that the inner edge of the ring is proximal to the outer edge of the doorknob base which is fixed to the door. Commonly used adhesive can be applied to the bottom half of the device to allow the apparatus to be attached to a door and to be positioned proximate to a doorknob as mentioned above. The device may also be attached to a door with screws inserted through the device. In an alternative embodiment, a gap can be included in the apparatus so that the ring is not continuous. However, the invention disclosed does not provide for use of the device itself as a handle, or pull or the like itself and must be used with a rigid handle or the like. Additionally, the dispensing portion of the device fits around the base of the knob or handle or the like and not directly over the touch point of the handle, knob, rail or pull, so the handle, knob, pull or rail or the like need not be used without the sanitary cover (e.g., in the case that the dispenser runs out of covers or the like). This invention would likely require significant enforcement to be consistently used properly. Additionally, attachment of the device to an object other than a knob or handle is not taught and it is not evident how this device would be used with other objects such as a flexible enclosure such as a privacy curtain or the like. Additionally, the above patent does not teach of devices that are suitable for application on a flexible enclosure device such as a privacy curtain or the like or of a temporary mounting means to said enclosure device.

Even in view of all these disclosures, there is currently an unmet need for a handle or pull device that quickly, easily and temporarily attaches to a flexible device such as a privacy curtain or the like and that provides a fresh, sanitary contact surface for said handle or pull with each use or as needed, and that is light in weight or low in mass so as to minimize or eliminate the "pendulum effect" associated with movement of said device when attached to a flexible enclosure device such as a privacy curtain or the like.

BRIEF DESCRIPTION OF THE INVENTION

Aspects and advantages of the invention will be set forth in part in the following description, or may be obvious from the description, or may be learned through practice of the invention.

A dispenser device is generally provided for removable attachment to a flexible enclosure. In one embodiment, the dispenser device comprises a dispenser body which defines a cavity therein and a plurality of barrier sheets within the cavity defined by the dispenser body. The dispenser body is configured to be removably attached over a contact point or surface of the flexible enclosure.

In one embodiment, the dispenser device further includes actuating means for clamping the dispenser body onto an edge defined by the flexible enclosure. For example, the dispenser device may include a pinch clamp configured to grip onto an edge defined by the flexible enclosure.

In another embodiment, the dispenser device may further include an intermediate device removably attached directly to the flexible enclosure and defining two sides, with each side being positioned on an opposite surface of an edge of the flexible enclosure. The intermediate device includes an attachment means on an outer surface configured to removably attach the dispenser body onto the intermediate device. For example, a pinch clamp configured to grip onto an edge defined by the flexible enclosure may be positioned on an interior surface of a bridge defined between the two sides. A second attachment means may be positioned on an interior surface of the intermediate device to removably attach to the intermediate device to the flexible enclosure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a perspective view of an exemplary contamination barrier dispenser in accordance with one embodiment of the present invention shown in an as-received configuration;

FIG. 2 is a perspective view of an exemplary contamination barrier dispenser in accordance with one embodiment of the present invention shown in an as-opened configuration, showing a plurality of disposable contamination barrier sheets;

FIG. 4 is a perspective view of an exemplary contamination barrier dispenser in accordance with one embodiment of the present invention shown in an as-used configuration on a hospital privacy curtain;

FIG. 5 is a perspective view of an exemplary contamination barrier dispenser in accordance with one embodiment of the present invention shown in an as-used configuration on a hospital privacy curtain when the dispenser is empty;

FIG. 6 is a perspective view of an exemplary intermediate device used for mounting to a flexible enclosure as well as serving as a platform for a contamination barrier dispenser in accordance with one embodiment of the present invention; and FIG. 7 is a perspective view of an exemplary intermediate device used for mounting to a flexible enclosure and with the contamination barrier dispenser installed in accordance with one embodiment of the present invention.

Figure 3:
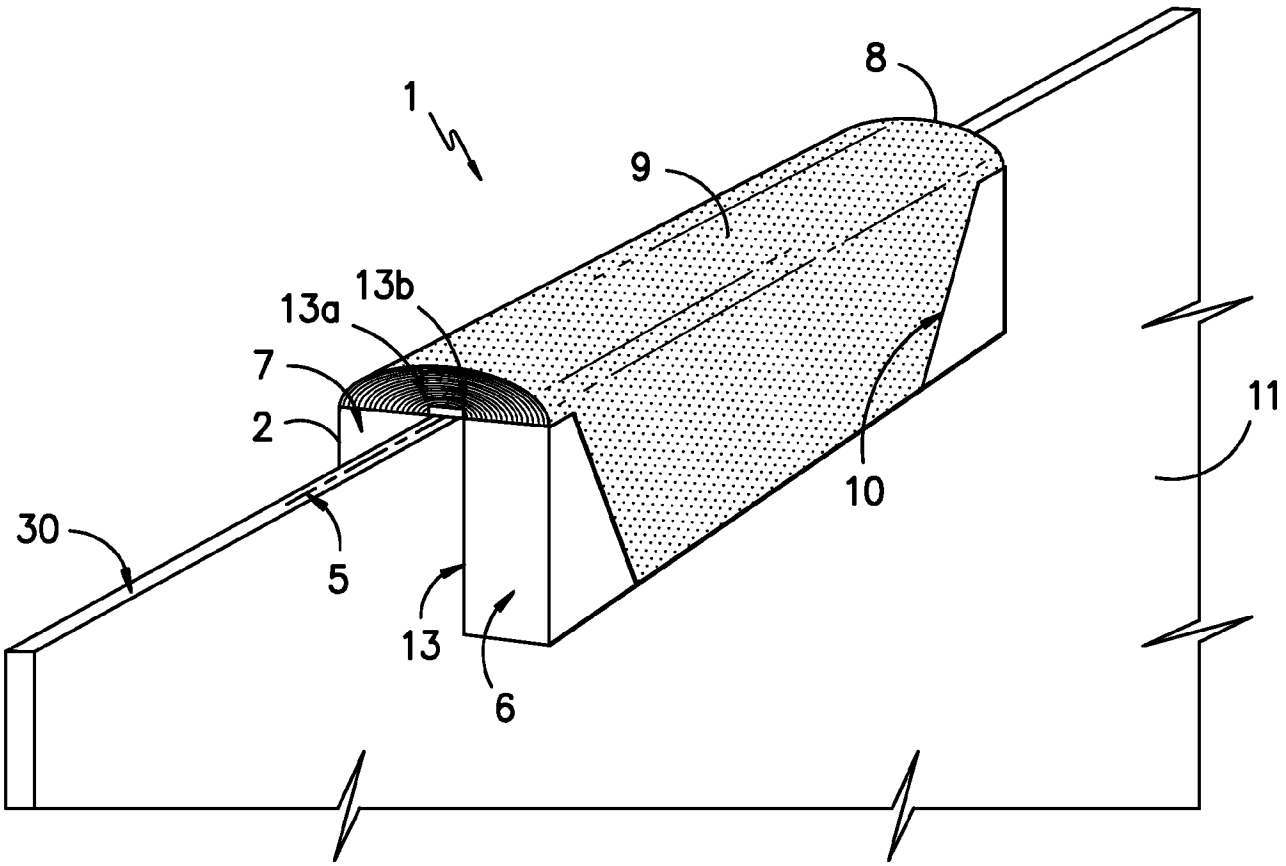
FIG. 3 is a perspective view of an exemplary contamination barrier dispenser in accordance with one embodiment of the present invention shown in an as-installed configuration on a flexible enclosure device such as a curtain such as a hospital privacy curtain.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Dispenser closing devices are generally provided for use with opening and closing flexible enclosures, such as privacy curtains or the like, in a manner that substantially reduces or eliminates transmission of contamination via the flexible enclosures. The dispenser closing device effectively serves the purpose of a handle being clamped to the flexible enclosure, and has a plurality of renewable surfaces that are sanitary or disinfecting in nature and that are not adhered to one another. In particular embodiments, the dispenser portion of the dispenser closing device is light weight to minimize the suspended mass on the flexible enclosure, and enables the introduction of a fresh touching or handling contact surface after each closing or opening action of the enclosure device to which the dispenser closing device is attached. The dispenser closing device is generally simple in that it requires few or no mechanical or moving parts to enable dispense of fresh surfaces. The dispenser closing device is attached to the flexible enclosure, in one embodiment, in a manner that does not damage the flexible enclosure. As such, the dispenser closing device is easy to use as well as install using a pinch type or compression or friction or magnetic clamp or other temporary attachment means or the like that does not damage the flexible enclosure. Additionally, the dispenser closing device can easily be removed for maintenance or replacement. The dispenser closing device may be used with various mounting mechanisms so as to enable contamination free closing and opening of numerous flexible enclosures such as curtains and the like. The invented devices may also be designed to include other elements or components that modify and improve the functionality of the dispenser closing device.

As such, the dispenser closing device can provide an easily replaceable, non-contaminated barrier between the user and the opening/closing mechanism of the flexible enclosure (e.g., an edge of the flexible enclosure or the like). The dispenser closing device can be temporarily mounted quickly and easily to a flexible enclosure such as a curtain or the like. The dispenser closing device for the non-contaminated barriers can be mounted either directly over the opening/closing mechanism (e.g., an edge of the flexible enclosure) or serve as the opening/closing mechanism itself. As such, the dispenser closing device can ensure a contamination free barrier at the point of use and is placed directly over the touch point.

The entire dispenser closing device is, in one particular embodiment, very light weight and low in mass so as to minimize or eliminate the "pendulum effect" for use with a flexible enclosure. The dispenser closing device is simple and designed specifically for use with flexible devices such as a curtain or the like and does not require actuation or alignment of the barrier as a part of use. The device may include one or more indicators either within the dispenser or on each protective barrier or both, in order to indicate that the dispenser is empty or to communicate other information, such as it is time to change the privacy curtain, or information or advertising or the like.

In one embodiment, the dispenser closing device disclosed herein includes a disposable dispenser mounted directly over a touch point area, so as to serve as a dispenser of disposable contamination barriers that are held by the dispenser so as to ensure that the user does not have direct contact with the opening/closing device and also to make it obvious when the disposable barriers have all been used and that the dispenser either needs to be replaced or refilled. The dispenser is designed so as to replace the touch point of the opening/closing means of the enclosure device with a disposable barrier that is renewable easily by the user and at the discretion of the user. Said dispenser may either be directly attached to a flexible enclosure such as a privacy curtain or the like, or it may be attached to a handle device that is specifically designed to either permanently or removably attach to said flexible enclosure device using a pinch clamp or a compression clamp or a friction clamp or a magnetic clamp or a means of temporary attachment or the like or a combination of clamps.

Referring to FIG. 1 and to FIG. 2, the dispenser device 1 is comprised of a dispenser body 2 that is shaped so as to hold a plurality of disposable contamination barrier sheets 9 during use. The dispenser 2 includes a removable portion 3 attached to boarders 10 along perforations 4. When it is time to install the device 1 onto a flexible enclosure, an installer removes the removable portion 3 of the dispenser 2 along perforations 4 (or the like) to leave borders 10 and to expose the contamination barrier sheets 9 within the dispenser 2. The installer then manipulates the dispenser 2 such that the dispenser device 1 is effectively folded around an edge 30 of the flexible enclosure 11, such as a privacy curtain or the like, as illustrated in FIG. 3.

For example, the dispenser body 2 can be folded generally about its longitudinal axis 5, or at multiple fold lines 13 that are generally parallel and in close proximity to its longitudinal axis 5. FIG. 3 shows the dispenser body 2 defining a pair of fold lines 13*a*, 13*b* that are substantially parallel to the longitudinal axis 5 of the device 1 and extend the entire longitudinal length of the dispenser body 2.

In one embodiment, the dispenser device 1 is mounted to the enclosure device as shown in FIG. 3 using means for attaching (i.e., attachment means) on each side 6, 7 of the flexible enclosure 11 so as to securely mount the dispenser device 1 in a removable manner that covers the touch point area of the flexible enclosure 11. For example, pads 14*a* and

14*b*, as best shown in FIG. 6, can include an adhesive layer (e.g., a pressure sensitive adhesive) or at least one of a hook-and-loop attachment surface that corresponds with an opposite hook-and-loop attachment surface on the flexible enclosure 11 or may physically attach to the flexible enclosure 11 by a pinching action or by compression or by friction or by magnetic attachment of pads 14*a* and 14*b* or the like. Other attachment means can include, but are not limited to, compression, pinching, grabbing, clamping, friction, magnets, puncturing mechanisms, sandpaper, tacks, staples, screws, bolts, etc. The mounting means may be singular or multiple and may reside anywhere on the sides of the device that contact the flexible enclosure device.

FIG. 4 illustrates the dispenser device 1 attached to a hospital privacy curtain 11 in its intended orientation. The dispenser device 1 is attached over both sides of the contact point area of the curtain being folded over axis 5 and secured to the curtain 11 by mounting means 14*a* and 14*b*. The portion 10 of the container 2 defines the boarder that exposes the disposable barrier sheets 9 therein. A compressing means may be employed within the dispenser in order to maintain pressure between the stack of the remaining portion of the contamination barrier sheets within the dispenser and the container portion of the dispenser as the barrier sheets are dispensed. Upon opening or closing the enclosure, the user grasps the outer most disposable barrier sheet in the stack of barrier sheets 9 and opens or closes the curtain. As the user completes the opening or closing action, he or she simply and easily removes and disposes of the outer most disposable barrier at his or her discretion. In that manner a non-contaminated touch point is ensured.

I. Sheets

In one particular embodiment, the dispenser portion of the device contains a plurality of clean or sanitized sheets, which may be treated with anti-microbial or other sanitizing or disinfecting treatments or light sensitive treatments or that are printed or the like. In one embodiment, the sanitized sheets are not adhered to each other within the stack. The sheets are preferably impervious to liquid, such as being a wax paper or the like. The sheets preferably slide easily upon one another. The sheets may be folded or have tabs so as to facilitate removal of said sheet after use. The user simply pulls the protective barrier out of the dispenser as part of the grasping/opening/closing action, exposing a fresh, non-contaminated barrier for the next grasping/opening/closing action. This action is very simple, requiring no training in order to ensure that it is used properly.

The disposable barrier sheets 9 may be treated with an indicator to show points of direct contact or to show contamination or to show other exposure. The disposable barrier sheets 9 may also be treated with an air freshener chemistry or the like. The disposable barrier sheets 9 may be treated with a disinfectant (either dry, wet or lotion) to assist in the passivation or destruction of contamination or the like. The disposable sheets 9 may be printed upon in order to further facilitate understanding of use (e.g., "grab here") or numbered to indicate how many sheets remain in the dispenser device 1, or printed with indicator ink so as to show atmospheric or light exposure or to indicate contamination or to indicate contamination on the hands or gloves of the user, or to indicate contact or to advertise or to educate the user. The printed surface may also be comprised of a glow-in-the-dark material so as to facilitate opening/closing of the enclosure in the dark so as to not disturb a sleeping patient or the like. The dispenser device 1 may also include a waste receptacle for the deposit of the used disposable barrier sheets or other amendments.

In accordance with another aspect of the invention, a plurality of contamination-free sheets is aligned, and stacked one over the other in a non-adhered fashion to create stack of disposable contamination-free sheets that is attached to a removable base that folds along an axis using a mechanical actuator means such as a spring hinge or the like and is securely, but temporarily attached to more than one side of the enclosure device, such as a privacy curtain or the like, directly over the contact point area. The user quickly and easily removes the existing contamination barrier sheet by means of pulling a tab that removes the entire contamination barrier to expose a new contamination barrier on each side of the enclosure device subsequent to opening/closing the enclosure device. The dispenser is mounted to the enclosure device over the touch point area and serves as the touch point. The dispenser is attached to the enclosure device in such a manner as to be secure, yet easily removable such as with hooks or clamping or the like.

II. Dispenser

The dispenser portion 2 of the device 1 may not contain moving parts or may have a minimum number of moving parts and is very simple. One embodiment of the invented device includes a disposable dispensing unit, made from cardboard or the like, that is opened along perforations to expose a plurality of contamination barrier sheets that are not adhered to each other, and is then folded along an axis (e.g., along at least one fold line), and is attached to a flexible enclosure device, such as a curtain or the like using a temporary attachment means that holds the dispenser unit securely in place and also allows for easy removal of the dispenser device, such as hook-type (e.g., hook and loop or "snake tooth") attachment means, or a pinch clamp or compression or friction or magnetic or adhesive attachment means or the like. The assistance of a light weight mechanical actuation device can be utilized in the device 1, if desired.

The sheets and dispenser become the touch point of the handle for opening and closing the curtain type enclosure. The user simply and easily removes each protective barrier as a part of the grasping/opening/closing process to reveal a new, contamination-free protective barrier for the next use.

In particular embodiments it is important to minimize the weight or mass of the device 1 so as to reduce or eliminate the "pendulum effect" due to mounting on a flexible enclosure. As such, the device 1 enables the reduction or elimination of transference related contamination from select touch points, including but not limited to privacy curtain touch points, in a manner that is efficient, effective and economical, without excessive weight, so as to avoid the "pendulum effect." That is, the flexible enclosure is typically suspended from the ceiling or the like from one dimension, and thus it is important that any handle, pull or the like that is attached to said flexible enclosure, be low in mass or weight so as to enable movement without a "pendulum effect." Additionally, it is important that said handle or pull is easily attached and removed from said flexible enclosure device so as to enable removal of said flexible enclosure device for laundering or replacement or the like. The attachment means for said handle, pull, or the like to said flexible enclosure device should also provide for fast and easy attach without damaging said flexible enclosure device. In order to minimize "pendulum effect," the entire device is designed to be light in weight and low in mass. The entire device (sans the flexible enclosure 11) should weigh less than 5 pounds, ideally less than 3 pounds and more ideally less than 1 pound.

In one particular embodiment, the device 1 includes a mechanical actuator 8 is comprised of one or more mechanisms, such as a spring hinge mechanism, that is latched open until installation, when the latch is removed to enable closure of the spring hinge mechanism 8 around the contact point area of the enclosure device. The mechanism 8 is preferably designed so as to impart compression of the dispenser device 1 onto more than one side of the flexible enclosure device over the contact point area so as to facilitate attachment of the dispenser device 1 to the flexible enclosure device through attachment means 6 and 7. The mechanism 8 may also include a latching mechanism to hold the dispenser device 1 in the folded position.

Attachment means 13 are preferably designed so as to provide secure attachment of the dispenser device 1 to the flexible enclosure 11 as well as to impart easy removal of the dispenser device 1 from the flexible enclosure 11 without significant damage to said enclosure. Such attachment means include, but are not limited to hooks, hook and loop fabrics, temporary adhesives, snaps, friction fittings (e.g., using rubber or sandpaper or the like), compression clamps, pinch clamps, magnetic clamps, puncture clamps or the like.

A second embodiment is shown in FIGS. 6 and 7. In this embodiment, an intermediate device 12 is used to attach directly to the flexible enclosure 11 in a manner that is either removable or permanent, via actuation means 62, which may either work freely via a spring hinge mechanism or the like, and attachment means 14*a* and 14*b*. The intermediate device 12 has two sides 15 and 16 that may be hingedly attached to or are otherwise interconnected via bridge 17 in a manner that allows said sides 15 and 16 to rotate on axes 18 and 19 so that sides 15 and 16 may be substantially parallel. Sides 15 and 16 may be attached to either the attachment means 14*a* and 14*b* or actuation means 62 or both in a manner that mechanically actuates motion of sides 15 and 16 so as to facilitate attachment to the flexible enclosure 11 without hindering attachment to said flexible enclosure 11. Intermediate device 12 has second attachment means 20 on each of side 15 and 16 to enable attachment of the dispenser device 1. The dispenser is similar to the dispenser device 1 of FIG. 1, with the exceptions that attachment means 13*a* and 13*b* are modified for attachment to the intermediate device 12 at 20 using a removable fastener (e.g., a hook and loop fastener or removable adhesive tape or the like) and that mechanical actuator 8 is either removed, or modified to enable conformance and attachment of the dispenser device 1 to the intermediate device 12 by enabling rotation or motion around axes 18 and 19.

During use, the intermediate device 12 is attached to the flexible enclosure 11 using attachment means 14*a* and 14*b*, which is opened either manually or using the actuation means 62, then aligned on the flexible enclosure 11, then closed either manually or using actuation means 62. Dispenser device 1, including the dispenser body 2, which extends and is foldable along a longitudinal axis 5, is then mounted to intermediate device 12 by attaching mounting means 6 and 7 on the dispenser device 1 via secondary attachment means 20 on the intermediate device 12 as illustrated in FIG. 7 to enable opening and closing of the flexible enclosure 11 by grasping clean sheets 9 which are held within dispenser device 1 which is attached to intermediate 12 which is attached to flexible enclosure 11 in a manner that allows opening and closing of said enclosure that is analogous to that shown in FIG. 3, FIG. 4 and FIG. 5 for the first embodiment. The attachment means may be multiple in number and may use multiple attachment mechanisms and may be placed anywhere on the sides of 15 and 16 that face each other on either side of the flexible enclosure 11.

A compressing means may be employed within the dispenser in order to maintain pressure between the stack of the remaining portion of the contamination barrier sheets 9 within the dispenser and the container portion of the dispenser as the barrier sheets are dispensed. Upon opening or closing the flexible enclosure 11, the user grasps the outer most disposable barrier sheet in the stack of barrier sheets 9 and opens or closes the flexible enclosure 11. As the user completes the opening or closing action, he or she simply and easily removes and disposes of the outer most disposable barrier at his or her discretion. In that manner a non-contaminated touch point is ensured. The disposable barrier sheets 9 may be treated with an indicator to show points of direct contact or to show contamination or to show other exposure. The disposable barrier sheets 9 may also be treated with an air freshener chemistry or material or the like. The disposable barrier sheets 9 may be treated with a disinfectant (either dry, wet or lotion or the like) to assist in the passivation or destruction of contamination or the like. The disposable sheets 9 may be printed upon in order to further facilitate understanding of use (e.g., "grab here") or numbered to indicate how many sheets remain in the dispenser device 1, or printed with indicator ink so as to show exposure or contamination or to indicate contamination on the hands or gloves of the user, or to indicate contact or to advertise or to educate the user. The surface or the printed surface may also be comprised of a glow-in-the-dark material or the like so as to facilitate opening/closing of the enclosure in the dark so as to not disturb a sleeping patient or the like. The dispenser device 1 may also include a waste receptacle for the deposit of the used disposable barrier sheets.

Attachment of dispenser device 1 to the intermediate device 12 is enabled via secondary attachment means 20 (e.g., hook and loop or removable adhesive or removable tape or the like). Attachment of the intermediate device 12 to flexible enclosure 11 is enabled via actuation means 62 or the like and is located within the interior volume defined by the interior surfaces 15, 16 and 17, that covers the contact surface of the flexible enclosure 11 and may be actuated via actuation means 62 or other actuation means to enable simple and ideally one hand operation. In certain embodiments, the actuation means 62 can be a spring hinge or the like. Multiple clamps may be used in order to ensure more secure mounting of intermediate device 12 to the flexible enclosure 11.

In order to minimize "pendulum effect," the entire device is designed to be light in weight and low in mass. The entire device (sans the flexible enclosure 11) should weigh less than 5 pounds, ideally less than 3 pounds and more ideally less than 1 pound.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dispenser device for removable attachment to a flexible enclosure, comprising:

a dispenser body that is foldable about a longitudinal axis of the dispenser body;

a plurality of barrier sheets removably held by the dispenser body, wherein the plurality of barrier sheets are arranged to form a stack and held by the dispenser body such that removal of a top barrier sheet of the stack exposes an underlying barrier sheet in the stack; and an intermediate device attached to the dispenser body and including two sides and a bridge, wherein each side is positioned on an opposite surface of the dispenser body, wherein an interior surface of each side of the intermediate device includes first attachment means comprising one of an adhesive layer, a hook and loon fastener, a pinching mechanism, a compression mechanism, a friction pad, a magnet, a puncturing mechanism, a screw, a tack, a staple, a screw, a bolt, or a combination thereof for attaching one side of the intermediate device to an opposite side of the intermediate device, and wherein the bridge is positioned along the longitudinal axis of the dispenser body;

wherein each side of the intermediate device further includes a second attachment means disposed on an exterior surface of each side of the intermediate device, wherein the exterior surface of each side of the intermediate device is located opposite the interior surface of each side of the intermediate device, wherein the second attachment means comprising one of a hook and loop fastener, an adhesive, a tape, or a combination thereof, wherein the second attachment means is configured to attach to a bottom surface of the dispenser body on the sides of the intermediate device.

2. The dispenser device as in claim 1, wherein the bridge includes a mechanical actuator having a spring hinge suitable for clamping down on the flexible enclosure via the sides of the intermediate device.

3. The dispenser device as in claim 1, wherein the barrier sheets comprise a sheet that is substantially impervious to liquids.

4. The dispenser device as in claim 1, wherein the dispenser body further comprises a back support.

5. The dispenser device as in claim 4, wherein the back support defines at least one fold line.

6. The dispenser device as in claim 5, wherein the back support defines a pair of fold lines, each fold line being substantially parallel to the longitudinal axis of the dispenser body.

7. The dispenser device as in claim 1, further comprising a pinch clamp.

8. The dispenser device as in claim 7, wherein the pinch clamp is positioned on an interior surface of the bridge.

9. A dispenser device for removable attachment to a flexible enclosure, comprising:

an intermediate device defining two sides, wherein each side is positioned on an opposite surface of the dispenser body, wherein an interior surface of each side of the intermediate device includes first attachment means comprising one of an adhesive layer, a hook and loop fastener, a pinching mechanism, a compression mechanism, a friction pad, a magnet, a puncturing mechanism, a screw, a tack, a stale, a screw, a bolt, or a combination thereof for attaching one side of the intermediate device to an opposite side of the intermediate device;

wherein each side of the intermediate device further includes a second attachment means disposed on an exterior surface of each side of the intermediate device, wherein the exterior surface of each side of the intermediate device is located opposite the interior surface of each side of the intermediate device, wherein the second attachment means comprising one of a hook and loop fastener, an adhesive, a tape, or a combination thereof, wherein the second attachment means is configured to attach to a bottom surface of the dispenser body;

a dispenser body which defines a cavity therein, the dispenser body being configured to be removably attached to the intermediate device; and a plurality of barrier sheets within the cavity defined by the dispenser body.

10. The dispenser device as in claim 9, wherein the intermediate device comprises a bridge positioned between the two sides.

11. The dispenser device as in claim 10, further comprising:

a pinch clamp, the pinch clamp being positioned on an interior surface of the bridge.

12. The dispenser device as in claim 9, wherein the barrier sheets are individually loose within the cavity.

13. The dispenser device as in claim 9, wherein the barrier sheets are configured such that removal of a single barrier sheet does not substantially affect the alignment of any underlying barrier sheets.

* * * * *